US008096772B2

(12) United States Patent
Liang

(10) Patent No.: US 8,096,772 B2
(45) Date of Patent: Jan. 17, 2012

(54) TURBINE VANE FOR A GAS TURBINE ENGINE HAVING SERPENTINE COOLING CHANNELS WITHIN THE INNER ENDWALL

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 488 days.

(21) Appl. No.: 12/407,960

(22) Filed: Mar. 20, 2009

(65) Prior Publication Data

US 2010/0239432 A1 Sep. 23, 2010

(51) Int. Cl.
*F01D 5/08* (2006.01)

(52) U.S. Cl. ..... 416/97 R; 416/193 A; 415/115

(58) Field of Classification Search ..... 415/115; 416/95, 96 R, 97 R, 193 A
See application file for complete search history.

(56) References Cited

U.S. PATENT DOCUMENTS

| | | | | |
|---|---|---|---|---|
| 3,726,604 | A | 4/1973 | Helms et al. | |
| 3,963,368 | A | 6/1976 | Emmerson | |
| 4,329,113 | A | 5/1982 | Ayache et al. | |
| 4,353,679 | A | 10/1982 | Hauser | |
| 4,946,346 | A | 8/1990 | Ito | |
| 4,962,640 | A | 10/1990 | Tobery | |
| 5,352,087 | A | 10/1994 | Antonellis | |
| 5,488,825 | A | 2/1996 | Davis et al. | |
| 5,516,260 | A | 5/1996 | Damlis et al. | |
| 5,645,397 | A | 7/1997 | Soechting et al. | |
| 5,954,475 | A * | 9/1999 | Matsuura et al. | 415/115 |
| 5,997,245 | A * | 12/1999 | Tomita et al. | 415/115 |
| 6,132,173 | A * | 10/2000 | Tomita et al. | 416/96 R |
| 6,190,130 | B1 * | 2/2001 | Fukue et al. | 416/97 R |
| 6,196,799 | B1 * | 3/2001 | Fukue et al. | 416/97 R |
| 6,241,467 | B1 * | 6/2001 | Zelesky et al. | 415/115 |
| 6,247,896 | B1 * | 6/2001 | Auxier et al. | 416/97 R |
| 6,254,333 | B1 * | 7/2001 | Merry | 415/115 |
| 6,428,270 | B1 | 8/2002 | Leone et al. | |
| 6,769,865 | B2 | 8/2004 | Kress et al. | |
| 6,955,523 | B2 | 10/2005 | McClelland | |
| 7,090,461 | B2 | 8/2006 | Liang | |
| 7,097,425 | B2 | 8/2006 | Cunha et al. | |
| 7,293,962 | B2 | 11/2007 | Fried et al. | |
| 7,416,391 | B2 * | 8/2008 | Veltre et al. | 416/97 R |
| 7,686,581 | B2 * | 3/2010 | Brittingham et al. | 416/97 R |
| 7,717,675 | B1 * | 5/2010 | Liang | 416/95 |
| 7,819,629 | B2 * | 10/2010 | Liang | 416/97 R |
| 2002/0150474 | A1 * | 10/2002 | Balkcum et al. | 416/97 R |
| 2003/0235494 | A1 * | 12/2003 | Draper | 415/115 |
| 2006/0056970 | A1 * | 3/2006 | Jacala et al. | 416/97 R |
| 2006/0269409 | A1 * | 11/2006 | Torii et al. | 416/97 R |
| 2008/0170946 | A1 * | 7/2008 | Brittingham et al. | 416/97 R |
| 2009/0304520 | A1 * | 12/2009 | Brittingham et al. | 416/97 R |

FOREIGN PATENT DOCUMENTS

| | | | |
|---|---|---|---|
| EP | 0894946 | A1 | 1/1998 |
| WO | 98/34013 | A1 | 8/1998 |

* cited by examiner

*Primary Examiner* — Matthew Landau
*Assistant Examiner* — Joseph C Nicely

(57) ABSTRACT

A turbine vane for a gas turbine engine having an internal cooling system in fluid communication with cooling channels positioned in the inner endwall is disclosed. The cooling system in the inner endwall may include cooling channels extending outwardly from the leading edge, trailing edge, pressure side and suction side toward the edges of the inner endwall. The cooling channels may be serpentine cooling channels and may be two or more serpentine cooling channels coupled together in series. The cooling channels may exhaust cooling fluids from the inner endwall through a plurality of orifices on an outer surface facing the opposing endwall and on the sides surfaces of the endwall. The pressure side and suction side midchord modulus serpentine flow circuits may receive cooling fluids from one pass of an internal midchord cooling channel and may exhaust those cooling fluids into another pass of the midchord cooling channel.

19 Claims, 2 Drawing Sheets

TURBINE VANE FOR A GAS TURBINE ENGINE HAVING SERPENTINE COOLING CHANNELS WITHIN THE INNER ENDWALL

FIELD OF THE INVENTION

This invention is directed generally to gas turbine engines, and more particularly to turbine vanes for gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoil. The airfoils include an internal cooling system for reducing the temperature of the airfoils. While there exist many configurations of cooling systems, there exists a need for improved cooling of gas turbine airfoils.

SUMMARY OF THE INVENTION

This invention is directed to a turbine vane for a gas turbine engine. The turbine vane may be configured to better accommodate high combustion gas temperatures than conventional vanes. In particular, the turbine vane may include an internal cooling system positioned within internal aspects of the vane and contained within an outer wall forming the vane. At least a portion of the cooling system may be contained within an inner endwall. The cooling channels in the inner endwall may be configured such that the cooling fluids are passed through the inner endwall and exhausted through an inward surface facing an opposing endwall and through side surfaces and mate faces to cool the vane. One or more of the cooling channels may circulate cooling fluids through the inner endwall, cool the inner endwall, and exhaust the cooling fluids into the internal cooling system positioned within the airfoil forming the turbine vane.

The turbine vane may be formed from a generally elongated airfoil that is formed from an outer wall, a leading edge, a trailing edge, a pressure side, a suction side generally opposite to the pressure side, an outer endwall at an outer end, an inner endwall at an inner end opposite the outer end, and an internal cooling system positioned within the generally elongated airfoil and in the inner endwall. The internal cooling system may include one or more internal chambers positioned within the generally elongated airfoil.

The internal cooling system may include cooling channels positioned within the inner endwall. In particular, a leading edge serpentine cooling channel may be positioned within the inner endwall at the inner end of the airfoil and between a leading edge of the inner endwall and the leading edge of the airfoil. The leading edge serpentine cooling channel may be in communication with the internal cooling system for receiving cooling fluids from the internal cooling system. The leading edge serpentine cooling channel may be coupled to a midchord cooling channel of the internal cooling system. The leading edge serpentine cooling channel may be formed from two modules, where each module is formed from a serpentine cooling channel. At least one of the serpentine cooling channels of the leading edge serpentine cooling channel may be formed from a five pass or six pass serpentine cooling channel, or other number of channels.

A first serpentine channel of the leading edge serpentine cooling channel may have an exhaust outlet on a first mate face, and a second serpentine cooling channel of the leading edge serpentine cooling channel may have an exhaust outlet on a second mate face that is generally opposite to the first mate face. The first and second serpentine cooling channels each may have inlets in communication with a midchord cooling channel in the airfoil. A plurality of orifices may extend from the first and second serpentine cooling channels to an outer side surface at the leading edge of the inner endwall that extends between the first and second mate faces.

A trailing edge serpentine cooling channel may be positioned within the inner endwall at the inner end of the airfoil and between a trailing edge of the inner endwall and the trailing edge of the airfoil. The trailing edge serpentine cooling channel may be in communication with the internal cooling system for receiving cooling fluids from the internal cooling system. The trailing edge serpentine cooling channel may be formed from two modules, where each module may be formed from a serpentine cooling channel. At least one of the serpentine cooling channels of the trailing edge serpentine cooling channel may be formed from a three pass serpentine cooling channel or other number of passes. A first serpentine channel of the trailing edge serpentine cooling channel may have an exhaust outlet on a first mate face, and a second serpentine cooling channel of the trailing edge serpentine cooling channel may have an exhaust outlet on a second mate face that is generally opposite to the first mate face. A plurality of orifices may extend from the first and second serpentine cooling channels of the trailing edge serpentine cooling channel to an outer side surface at the leading edge of the inner endwall that extends between the first and second mate faces. An inlet of the trailing edge serpentine cooling channel may be in fluid communication with a trailing edge cooling channel of the internal cooling system.

A pressure side midchord modulus serpentine flow circuit may be positioned within the inner endwall at the inner end of the airfoil, proximate to the pressure side of the airfoil and between the leading and trailing edge serpentine cooling channels. The pressure side midchord modulus serpentine flow circuit may be in communication with the internal cooling system for receiving cooling fluids from the internal cooling system. The pressure side midchord modulus serpentine flow circuit may be formed from at least one serpentine cooling channel. The pressure side midchord modulus serpentine flow circuit may be formed from at least two serpentine cooling channels coupled together in series. The internal cooling system may include a midchord serpentine cooling channel extending generally spanwise. An inlet of a first serpentine cooling channel of the pressure side midchord modulus serpentine flow circuit may be in communication with a pass extending in a first direction, and an outlet of a second serpentine cooling channel of the pressure side midchord modulus serpentine flow circuit may be in communication with another pass extending in a second direction opposite to the first direction.

A suction side midchord modulus serpentine flow circuit may be positioned within the inner endwall at the inner end of the airfoil, proximate to the suction side of the airfoil and between the leading and trailing edge serpentine cooling channels. The suction side midchord modulus serpentine flow circuit may be in communication with the internal cooling system for receiving cooling fluids from the internal cooling system. The suction side midchord modulus serpentine flow circuit may be formed from at least one serpentine cooling channel. The suction side midchord modulus serpentine flow circuit may include at least two serpentine cooling channels coupled together in series. The internal cooling system may include a midchord serpentine cooling channel extending generally spanwise. An inlet of a first serpentine cooling channel of the suction side midchord modulus serpentine flow circuit may be in communication with a pass extending in a first direction, and an outlet of a second serpentine cooling channel of the suction side midchord modulus serpentine flow circuit may be in communication with another pass extending in a second direction opposite to the first direction.

An advantage of the cooling system is that the serpentine cooling channels of the inner endwall are in communication with the cooling channels of the internal cooling system.

Another advantage of the cooling system is that the serpentine cooling channels of the pressure and suction side midchord modulus serpentine flow circuits in the inner endwall provide the necessary cooling and eliminate the use of turn manifolds.

Yet another advantage of this invention is that single cooling flow entrances for the serpentine flow channels provide robust cooling flow control capability.

Another advantage of the cooling system is that the multiple modulus serpentine flow circuits and the multiple edge cooling orifices yield a higher overall cooling effectiveness.

Still another advantage of the cooling system is that the multiple edge cooling orifices used in the edge perimeter achieves better vane edge cooling and lowers the edge section metal temperature.

Another advantage of the cooling system is that each module, the leading edge serpentine cooling channel, the trailing edge serpentine cooling channel, and the pressure side and suction side midchord modulus serpentine flow circuits, may be tailored to the specific heat loads at each region.

Still another advantage of the cooling system is that the cooling system is designed into small cooling modules that increase the design flexibility.

Another advantage of the cooling system is that a radially inner surface of the inner endwall may be configured to be smooth such that an abradable pad may be attached to the such smooth surface to form a seal between adjacent components.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
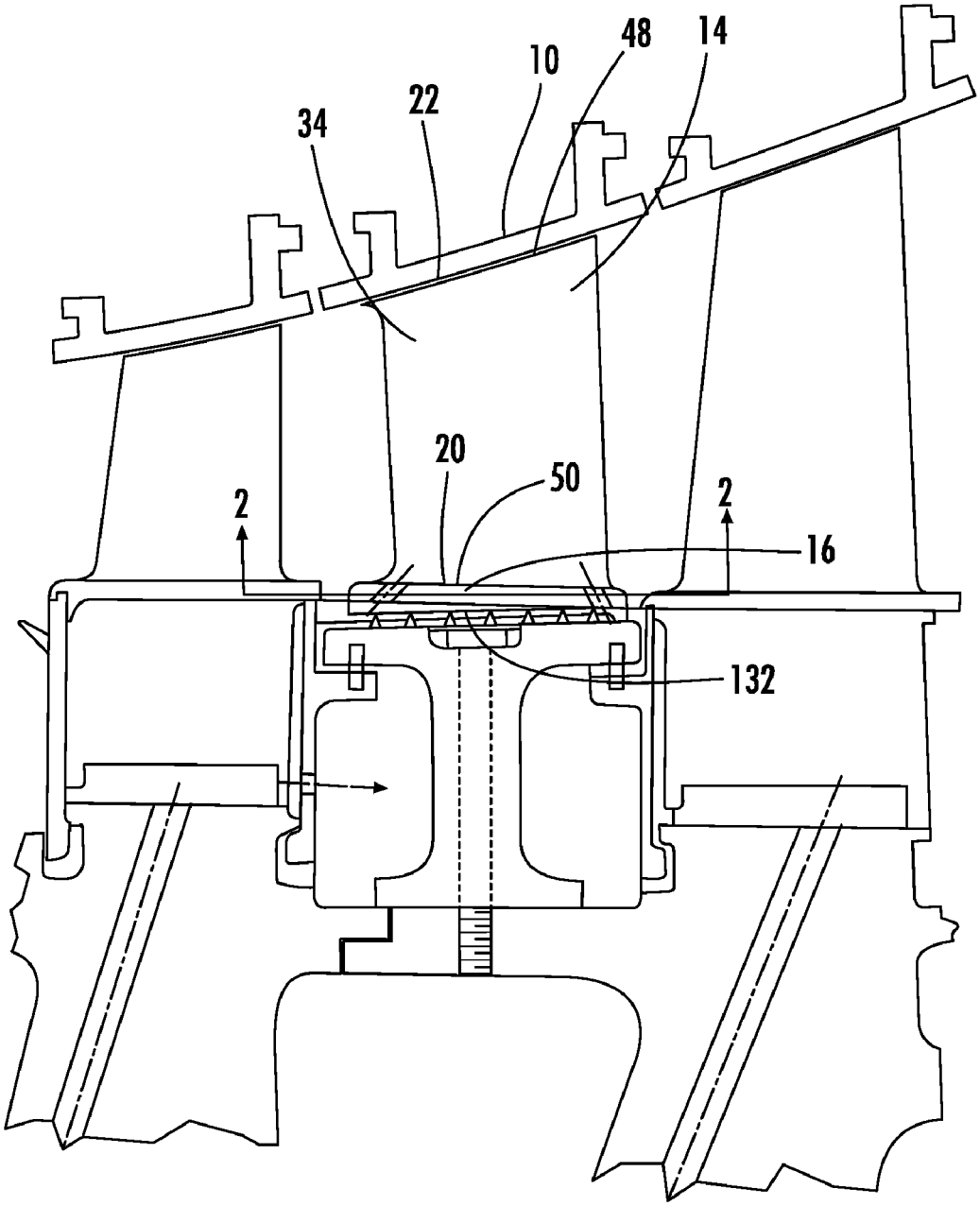
FIG. 1 is a side view of a turbine vane with aspects of this invention.
Figure 2:
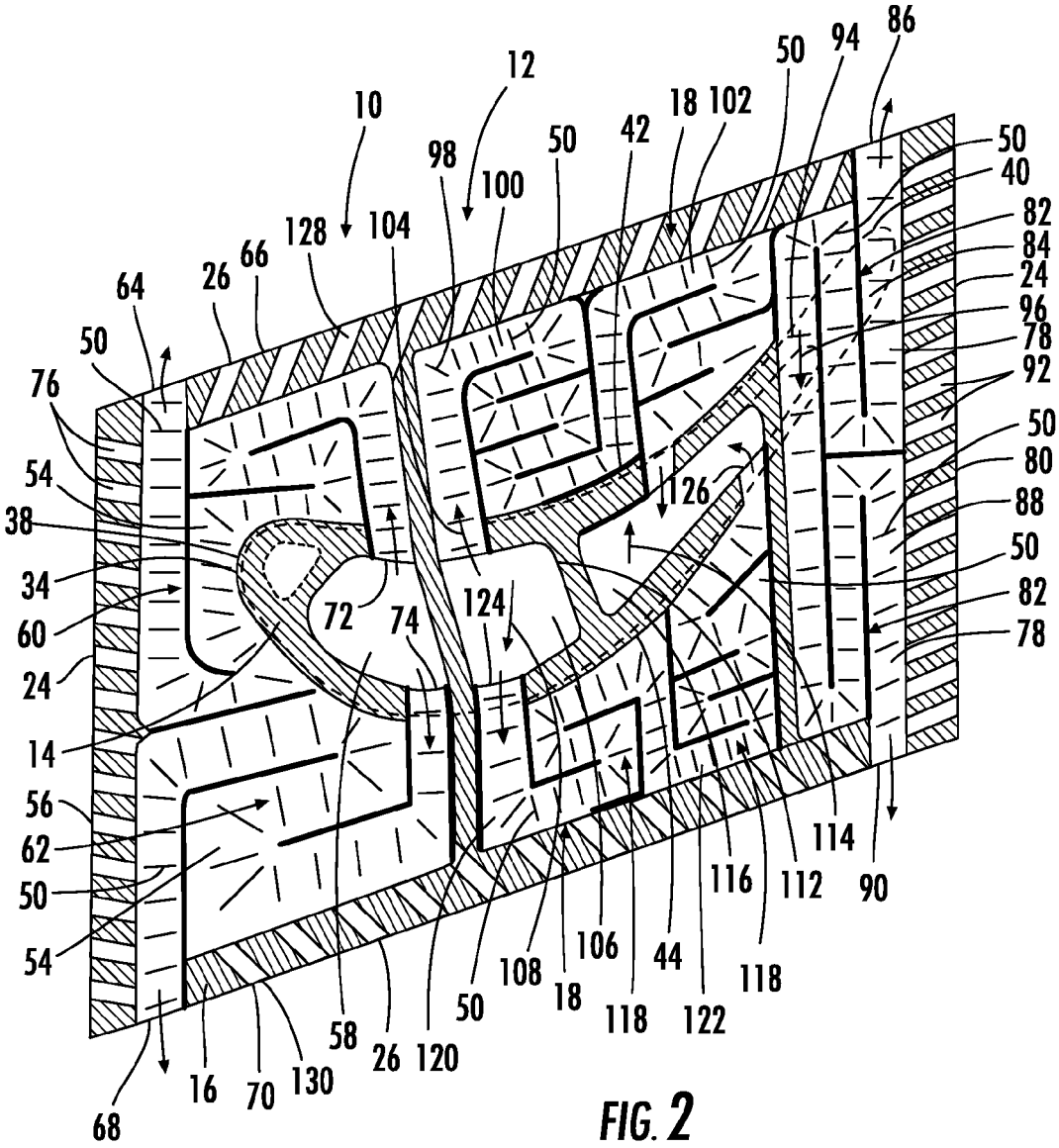
FIG. 2 is a cross-sectional view of the inner endwall of the turbine vane taken at section line 2-2 in FIG. 1, which shows the cooling channels positioned within the inner endwall.

As shown in FIGS. 1-2, this invention is directed to a turbine vane 10 for a gas turbine engine. The turbine vane 10 may be configured to better accommodate high combustion gas temperatures than conventional vanes. In particular, the turbine vane 10 may include an internal cooling system 12 positioned within internal aspects of the vane 10 and contained within an outer wall 14 forming the vane 10. At least a portion of the cooling system 12 may be contained within an inner endwall 16. The cooling channels 18 in the inner endwall 16 may be configured such that the cooling fluids are passed through the inner endwall 16 and exhausted through an inward surface 20 facing an opposing endwall 22 and through side surfaces 24 and mate faces 26 to cool the vane 10. One or more of the cooling channels 18 may circulate cooling fluids through the inner endwall 16, cool the inner endwall 16, and exhaust the cooling fluids into the internal cooling system 12 positioned within the airfoil 34 forming the turbine vane 10.

The turbine vane 10 may have any appropriate configuration and, in at least one embodiment, may be formed from a generally elongated airfoil 34 formed from the outer wall 14, and having a leading edge 38, a trailing edge 40, a pressure side 42, a suction side 44 generally opposite to the pressure side 42, an outer endwall 22 at a first end 48, an inner endwall 16, which is the inner endwall 16, at a second end 52 opposite the first end 48, and an internal cooling system 12 positioned within the generally elongated airfoil 34. The internal cooling system 12 may include at least one internal supply chamber 18 positioned within the generally elongated airfoil 34. The internal supply chamber 18 may have any appropriate configuration and may extend from the outer endwall 22 to the inner endwall 16 and may be positioned within the inner endwall.

The cooling system 12 may include a leading edge serpentine cooling channel 54 positioned within the inner endwall 16 at the inner end 52 of the airfoil 34 and between a leading edge 56 of the inner endwall 16 and the leading edge 38 of the airfoil 34. The leading edge serpentine cooling channel 54 may be in communication with the internal cooling system 12 for receiving cooling fluids from the internal cooling system 12. The leading edge serpentine cooling channel 54 may be coupled to a midchord cooling channel 58 of the internal cooling system 12 to receive cooling fluids. The midchord cooling channel 58 may have any appropriate configuration. The leading edge serpentine cooling channel 54 may be formed from two modules, where each module comprises a serpentine cooling channel. As shown in FIG. 2, one of the serpentine cooling channels 60 of the leading edge serpentine cooling channel 54 comprises a six pass serpentine cooling channel. The other serpentine cooling channel 62 of the leading edge serpentine cooling channel 54 comprises a five pass serpentine cooling channel.

The first serpentine channel 60 of the leading edge serpentine cooling channel 54 may have one or more exhaust outlets 64 on a first mate face 66. A second serpentine cooling channel 62 of the leading edge serpentine cooling channel 54 may have one or more exhaust outlets 68 on a second mate face 70 that is generally opposite to the first mate face 66. The first and second serpentine cooling channels 60, 62 may each have inlets 72, 74 in communication with a midchord cooling channel 58 in the airfoil 34. The first and second serpentine cooling channels 60, 62 may include trip strips 50 in a portion of the channels or throughout the channels. A plurality of orifices 76 may extend from the first and second serpentine cooling channels 60, 62 to an outer side surface 24 at the leading edge 56 of the inner endwall 16 that extends between the first and second mate faces 66, 70.

The internal cooling system 10 may include a trailing edge serpentine cooling channel 78 positioned within the inner endwall 16 at the inner end 52 of the airfoil 34 and between a trailing edge 80 of the inner endwall 16 and the trailing edge 40 of the airfoil 34. The trailing edge serpentine cooling channel 78 may be in communication with the internal cooling system 12 for receiving cooling fluids from the internal cooling system 12. In one embodiment, the trailing edge serpentine cooling channel 78 may be formed from two modules 82. Each of the modules 82 may be a serpentine cooling channel. In one embodiment, one or more of the serpentine cooling channels of the trailing edge serpentine cooling channel 78 may be a three pass serpentine cooling channel.

A first serpentine channel 84 of the trailing edge serpentine cooling channel 78 may have an exhaust outlet 86 on the first mate face 66. A second serpentine cooling channel 88 of the trailing edge serpentine cooling channel 78 may have an exhaust outlet 90 on the second mate face 70 that is generally opposite to the first mate face 66. A plurality of orifices 92 may extend from the first and second serpentine cooling channels 84, 88 of the trailing edge serpentine cooling channel 78 to an outer side surface 24 at the trailing edge of the inner endwall that extends between the first and second mate faces 66, 70. The trailing edge serpentine cooling channel 78 may include one or more trip strips 50 positioned in a portion of or throughout the channel 78. The trailing edge serpentine cooling channel 78 may include an inlet 94 of the trailing edge serpentine cooling channel 78 that is in fluid communication with a trailing edge cooling channel 96 of the internal cooling system 12.

The cooling system 12 may include a pressure side midchord modulus serpentine flow circuit 98 positioned within the inner endwall 16 at the inner end 48 of the airfoil 34 proximate to the pressure side 42 of the airfoil 34 and between the leading and trailing edge serpentine cooling channels 54, 78. The pressure side midchord modulus serpentine flow circuit 98 may be in communication with the internal cooling system 12 for receiving cooling fluids from the internal cooling system 12. The pressure side midchord modulus serpentine flow circuit 98 may be formed from one or more serpentine cooling channels. The pressure side midchord modulus serpentine flow circuit 98 may be formed from two or more serpentine cooling channels 100, 102 coupled together in series. The pressure side midchord modulus serpentine flow circuit 98 may include trip strips 50 in a portion of or throughout the serpentine cooling channels 100, 102.

An inlet 104 of a first serpentine cooling channel 100 of the pressure side midchord modulus serpentine flow circuit 98 may be in communication with a pass 106 extending in a first direction 108. An outlet 110 of a second serpentine cooling channel 102 of the pressure side midchord modulus serpentine flow circuit 98 may be in communication with another pass 112 extending in a second direction 114 opposite to the first direction 108. Thus, the pressure side midchord modulus serpentine flow circuit 98 may receive cooling fluids from the midchord cooling chamber 116 and exhaust those used cooling fluids back into another pass 112 of the midchord cooling chamber 116, thereby preheating the cooling fluids for use in other portions of the internal cooling system 12 within the generally elongated airfoil 34. The pressure side midchord modulus serpentine flow circuit 98 may also exhaust cooling fluids through a plurality of orifices 128 positioned on the first mate face 66.

The internal cooling system 12 may include a suction side midchord modulus serpentine flow circuit 118 positioned within the inner endwall 16 at the inner end 52 of the airfoil 34, proximate to the suction side 44 of the airfoil 34 and between the leading and trailing edge serpentine cooling channels 54, 78. The suction side midchord modulus serpentine flow circuit 118 may be in communication with the internal cooling system 12 for receiving cooling fluids from the internal cooling system 12. The suction side midchord modulus serpentine flow circuit 118 may be formed from one or more serpentine cooling channels. In one embodiment, the suction side midchord modulus serpentine flow circuit 118 may be formed from two or more serpentine cooling channels 120, 122 coupled together in series. An inlet 124 of a first serpentine cooling channel 120 of the suction side midchord modulus serpentine flow circuit 118 may be in communication with the pass 106 extending in the first direction 108, and an outlet 126 of the second serpentine cooling channel 122 of the suction side midchord modulus serpentine flow circuit 118 may be in communication with another pass 112 extending in a second direction 114 opposite to the first direction 108. The suction side midchord modulus serpentine flow circuit 118 may include trip strips 50 in a portion of or throughout the serpentine cooling channels 100, 102. The suction side midchord modulus serpentine flow circuit 118 may also exhaust cooling fluids through a plurality of orifices 128 positioned on the second mate face 70.

The cooling channels 18 in the inner endwall 16 may be constructed in a number of ways. In particular, the cooling channels 18 may be formed through a casting process, by casting the configuration of the cooling channels 18 into the inner endwall 16, machining the cooling channels into the inner endwall 16 and covering the channels with a backing plate that may be attached via a TLP bonding process. The configuration of the cooling channels 18 enables the formation of a flat external surface 132 that can act as a base to which an abradable sealing pad may be attached.

As shown in FIG. 2, the cooling channels 18 may be configured such that the cooling channels 18 may fill substantially all of the area between the edges of the generally elongated airfoil 34 and the side surfaces 24 and mate faces 26, 66, 70. The cooling channels 18 may be configured such that the cooling channels 18 fill most of the area in the inner endwall 16 to efficiently cool the inner endwall 16.

During use, cooling fluids may enter the turbine vane 10 into the internal supply cooling supply system 12 and flow through the outer endwall 22 and the first end 48 and into the generally elongated airfoil 34. In particular, the cooling fluids may flow into the midchord cooling channel 58, the midchord cooling chamber 116, and the trailing edge cooling channel 96. A portion of the cooling fluids from the midchord cooling channel 58 may flow into the leading edge serpentine cooling channel 54. The cooling fluids may flow throughout the channel and be exhausted through exhaust outlets 64, 68 onto mate faces 66, 70 and may be exhausted through orifices 76 at the side surface 24. A portion of the cooling fluids from the midchord cooling chamber 116 may flow into the inlets 104, 124 of the pressure side and suction side midchord modulus serpentine flow circuits 98, 118. The cooling fluids may flow throughout the channels and trip strips 50, through the outlets 110, 126 and back into the midchord cooling chambers 116, and a portion of the cooling fluids may be exhausted through the orifices 128, 130 in the first and second mate faces 66, 70. A portion of the cooling fluids may also flow from the trailing edge cooling channel 96 into the trailing edge serpentine cooling channel 78, such as the first and second channels 84, 88, and may be exhausted from the exhaust outlets 86, 90.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine vane for a gas turbine engine, comprising:

a generally elongated airfoil formed from an outer wall, and having a leading edge, a trailing edge, a pressure side, a suction side generally opposite to the pressure side, an outer endwall at an outer end, an inner endwall at an inner end opposite the outer end, and an internal cooling system positioned within the generally elongated airfoil and in the inner endwall;

wherein the internal cooling system includes at least one internal chamber positioned within the generally elongated airfoil;

a leading edge serpentine cooling channel positioned within the inner endwall at the inner end of the airfoil and between a leading edge of the inner endwall and the leading edge of the airfoil, wherein the leading edge serpentine cooling channel is in communication with the internal cooling system for receiving cooling fluids from the internal cooling system, wherein the leading edge serpentine cooling channel is formed from two modules, where each module comprises a serpentine cooling channel;

a trailing edge serpentine cooling channel positioned within the inner endwall at the inner end of the airfoil and between a trailing edge of the inner endwall and the trailing edge of the airfoil, wherein the trailing edge serpentine cooling channel is in communication with the internal cooling system for receiving cooling fluids from the internal cooling system;

a pressure side midchord modulus serpentine flow circuit positioned within the inner endwall at the inner end of the airfoil, proximate to the pressure side of the airfoil and between the leading and trailing edge serpentine cooling channels, wherein the pressure side midchord modulus serpentine flow circuit is in communication with the internal cooling system for receiving cooling fluids from the internal cooling system and wherein the pressure side midchord modulus serpentine flow circuit is formed from at least one serpentine cooling channel;

a suction side midchord modulus serpentine flow circuit positioned within the inner endwall at the inner end of the airfoil, proximate to the suction side of the airfoil and between the leading and trailing edge serpentine cooling channels, wherein the suction side midchord modulus serpentine flow circuit is in communication with the internal cooling system for receiving cooling fluids from the internal cooling system and wherein the suction side midchord modulus serpentine flow circuit is formed from at least one serpentine cooling channel.

2. The turbine vane of claim 1, wherein the pressure side midchord modulus serpentine flow circuit comprises at least two serpentine cooling channels coupled together in series.

3. The turbine vane of claim 2, wherein the internal cooling system includes a midchord serpentine cooling channel extending generally spanwise, wherein an inlet of a first serpentine cooling channel of the pressure side midchord modulus serpentine flow circuit is in communication with a pass extending in a first direction and an outlet of a second serpentine cooling channel of the pressure side midchord modulus serpentine flow circuit is in communication with another pass extending in a second direction opposite to the first direction.

4. The turbine vane of claim 1, wherein the suction side midchord modulus serpentine flow circuit comprises at least two serpentine cooling channels coupled together in series.

5. The turbine vane of claim 4, wherein the internal cooling system includes a midchord serpentine cooling channel extending generally spanwise, wherein an inlet of a first serpentine cooling channel of the suction side midchord modulus serpentine flow circuit is in communication with a pass extending in a first direction and an outlet of a second serpentine cooling channel of the suction side midchord modulus serpentine flow circuit is in communication with another pass extending in a second direction opposite to the first direction.

6. The turbine vane of claim 1, wherein the leading edge serpentine cooling channel is coupled to a midchord cooling channel of the internal cooling system.

7. The turbine vane of claim 1, wherein at least one of the serpentine cooling channels of the leading edge serpentine cooling channel comprises a six pass serpentine cooling channel.

8. The turbine vane of claim 1, wherein at least one of the serpentine cooling channels of the leading edge serpentine cooling channel comprises a five pass serpentine cooling channel.

9. The turbine vane of claim 1, wherein a first serpentine channel of the leading edge serpentine cooling channel has an exhaust outlet on a first mate face, and a second serpentine cooling channel of the leading edge serpentine cooling channel has an exhaust outlet on a second mate face that is generally opposite to the first mate face.

10. The turbine vane of claim 9, wherein the first and second serpentine cooling channels each have inlets in communication with a midchord cooling channel in the airfoil.

11. The turbine vane of claim 10, further comprising a plurality of orifices extending from the first and second serpentine cooling channels to an outer side surface at the leading edge of the inner endwall that extends between the first and second mate faces.

12. The turbine vane of claim 1, wherein the trailing edge serpentine cooling channel is formed from two modules, where each module comprises a serpentine cooling channel.

13. The turbine vane of claim 12, wherein at least one of the serpentine cooling channels of the trailing edge serpentine cooling channel comprises a three pass serpentine cooling channel.

14. The turbine vane of claim 12, wherein a first serpentine channel of the trailing edge serpentine cooling channel has an exhaust outlet on a first mate face, and a second serpentine cooling channel of the trailing edge serpentine cooling channel has an exhaust outlet on a second mate face that is generally opposite to the first mate face.

15. The turbine vane of claim 14, further comprising a plurality of orifices extending from the first and second serpentine cooling channels of the trailing edge serpentine cooling channel to an outer side surface at the trailing edge of the inner endwall that extends between the first and second mate faces.

16. The turbine vane of claim 14, further comprising an inlet of the trailing edge serpentine cooling channel that is in fluid communication with a trailing edge cooling channel of the internal cooling system.

17. A turbine vane for a gas turbine engine, comprising:

a generally elongated airfoil formed from an outer wall, and having a leading edge, a trailing edge, a pressure side, a suction side generally opposite to the pressure side, an outer endwall at an outer end, an inner endwall at an inner end opposite the outer end, and an internal cooling system positioned within the generally elongated airfoil and in the inner endwall;

wherein the internal cooling system includes at least one internal chamber positioned within the generally elongated airfoil;

a leading edge serpentine cooling channel positioned within the inner endwall at the inner end of the airfoil and between a leading edge of the inner endwall and the leading edge of the airfoil, wherein the leading edge serpentine cooling channel is in communication with the internal cooling system for receiving cooling fluids from the internal cooling system, wherein the leading edge serpentine cooling channel is formed from two modules, where each module comprises a serpentine cooling channel;

a trailing edge serpentine cooling channel positioned within the inner endwall at the inner end of the airfoil and between a trailing edge of the inner endwall and the trailing edge of the airfoil, wherein the trailing edge serpentine cooling channel is in communication with the internal cooling system for receiving cooling fluids from the internal cooling system;

a pressure side midchord modulus serpentine flow circuit positioned within the inner endwall at the inner end of the airfoil, proximate to the pressure side of the airfoil and between the leading and trailing edge serpentine cooling channels, wherein the pressure side midchord modulus serpentine flow circuit is in communication with the internal cooling system for receiving cooling fluids from the internal cooling system and wherein the pressure side midchord modulus serpentine flow circuit is formed from at least one serpentine cooling channel;

a suction side midchord modulus serpentine flow circuit positioned within the inner endwall at the inner end of the airfoil, proximate to the suction side of the airfoil and between the leading and trailing edge serpentine cooling channels, wherein the suction side midchord modulus serpentine flow circuit is in communication with the internal cooling system for receiving cooling fluids from the internal cooling system and wherein the suction side midchord modulus serpentine flow circuit is formed from at least one serpentine cooling channel;

wherein the internal cooling system includes a midchord serpentine cooling channel extending generally spanwise, wherein an inlet of a first serpentine cooling channel of the pressure side midchord modulus serpentine flow circuit is in communication with a pass extending in a first direction and an outlet of a second serpentine cooling channel of the pressure side midchord modulus serpentine flow circuit is in communication with another pass extending in a second direction opposite to the first direction;

wherein an inlet of a first serpentine cooling channel of the suction side midchord modulus serpentine flow circuit is in communication with the pass extending in the first direction and an outlet of a second serpentine cooling channel of the suction side midchord modulus serpentine flow circuit is in communication with the other pass extending in the second direction opposite to the first direction;

wherein a first serpentine channel of the leading edge serpentine cooling channel has an exhaust outlet on a first mate face, and a second serpentine cooling channel of the leading edge serpentine cooling channel has an exhaust outlet on a second mate face that generally opposite to the first mate face; and wherein a first serpentine channel of the trailing edge serpentine cooling channel has an exhaust outlet on a first mate face, and a second serpentine cooling channel of the trailing edge serpentine cooling channel has an exhaust outlet on a second mate face that is generally opposite to the first mate face.

18. The turbine vane of claim 17, further comprising a plurality of orifices extending from the first and second serpentine cooling channels of the trailing edge serpentine cooling channel to an outer side surface at the trailing edge of the inner endwall that extends between the first and second mate faces.

19. The turbine vane of claim 17, further comprising an inlet of the trailing edge serpentine cooling channel that is in fluid communication with a trailing edge cooling channel of the internal cooling system.

* * * * *